US006076669A

United States Patent [19]

Ling

[11] Patent Number: 6,076,669

[45] Date of Patent: Jun. 20, 2000

[54] TOOL DISPLAY RACK

[75] Inventor: David Ling, Taichung, Taiwan

[73] Assignee: Hand Tool Design Corporation, Wilmington, Del.

[21] Appl. No.: 09/149,492

[22] Filed: Sep. 8, 1998

[51] Int. Cl.[7] ..... B65D 75/56

[52] U.S. Cl. ..... 206/349; 206/477; 206/480; 206/806; 206/807; 211/70.6

[58] Field of Search ..... 206/349, 372, 206/376, 377, 378, 461, 462, 464, 465, 471, 1.5, 480–483, 806, 807, 477; 211/70.6

[56] References Cited

U.S. PATENT DOCUMENTS

| | | | |
|---|---|---|---|
| 4,378,068 | 3/1983 | Bell | 206/806 |
| 4,634,005 | 1/1987 | Kulzer et al. | 206/349 |
| 5,044,591 | 9/1991 | Huang | 211/70.6 |
| 5,704,260 | 1/1998 | Huang | 206/378 |
| 5,713,467 | 2/1998 | Kao | 206/377 |
| 5,816,401 | 10/1998 | Vasudeva et al. | 206/377 |

*Primary Examiner*—Paul T. Sewell
*Assistant Examiner*—Luan K. Bui
*Attorney, Agent, or Firm*—Charles E. Baxley, Esq.

[57] ABSTRACT

A tool display rack includes a body with a first engaging member extending from the first end thereof in which a first aperture is defined, a limiting member connected to the body at its first end by a connecting plate and having a recess defined therein, a second engaging member extending from the second end of the limiting member so as to engage with the first aperture, a second aperture defined in the second end of the limiting member so as to receive the first engaging member so that a tool extends through the recess between the body and the limiting member and is limited by the limiting member. The tool can only be taken away from the body by cutting the second engaging member extending through the first aperture in the body.

1 Claim, 7 Drawing Sheets

TOOL DISPLAY RACK

FIELD OF THE INVENTION

The present invention relates to a tool display rack, and more particularly, to an improved tool display rack having a body with a limiting member pivotally connected to the body, the limiting member and the body respectively having a hook member and an aperture so as to fixedly connect with each other wherein a tool such as spanner extends through the gap defined between the body and the limiting member.

BACKGROUND OF THE INVENTION

Conventional tool display rack includes a paper-made card with a hole defined in one of two ends thereof so as to hang the card to a nail on the display wall, a tool is fixedly attached to the card by a wire extending through the card and wrapping around the handle of the tool. The tool is easily taken away from the card by cutting the wire or just pulling the tool from the card. In order to prevent the shortcoming of the tool rack, a plastic and transparent cover is further used to fixedly connect to the card so that the tool can be seen via the cover and is not accessed unless the cover is disengaged from the card. Nevertheless, a high manufacturing cost is incurred because it takes a lot of processes to attach the tool to the card and to fixedly connect the cover to the card. Each of the processes are performed on different machines. Customers prefer to touch the tool by their hands to feel the surface of the tool to grasp the handle of the tool, these will help them to decide which one is suitable to them. The cover cannot provide such the advantages to the customers. In addition, the cover tends to be deformed by an impact and the deformation could be a permanent deformation.

The present invention provides a display rack which is easily manufactured and easily to use. The tool connected to the display rack cannot be taken away except that the hook of the limiting member engaged with the aperture in the body is cut so that the shortcomings of the conventional tool display racks are well improved.

SUMMARY OF THE INVENTION

In accordance with one aspect of the present invention, there is provided a tool display rack comprising a body having a first aperture defined in the first end thereof and located near the first side of the body, a first engaging member extending from the body and located near the first side of the body which has a connecting plate extending from the second side thereof. A limiting member has the first end thereof connected to the connecting plate and a recess defined therein. A second aperture is defined in the second end of the limiting member so as to receive the first engaging member of the body. A second engaging member extends from the second end of the limiting member so as to engage with the first aperture in the body.

An object of the present invention is to provide a tool rack having a limiting member integrally connected to the body of the rack.

Another embodiment of the present invention is to provide a tool display rack which is easily to be manufactured.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
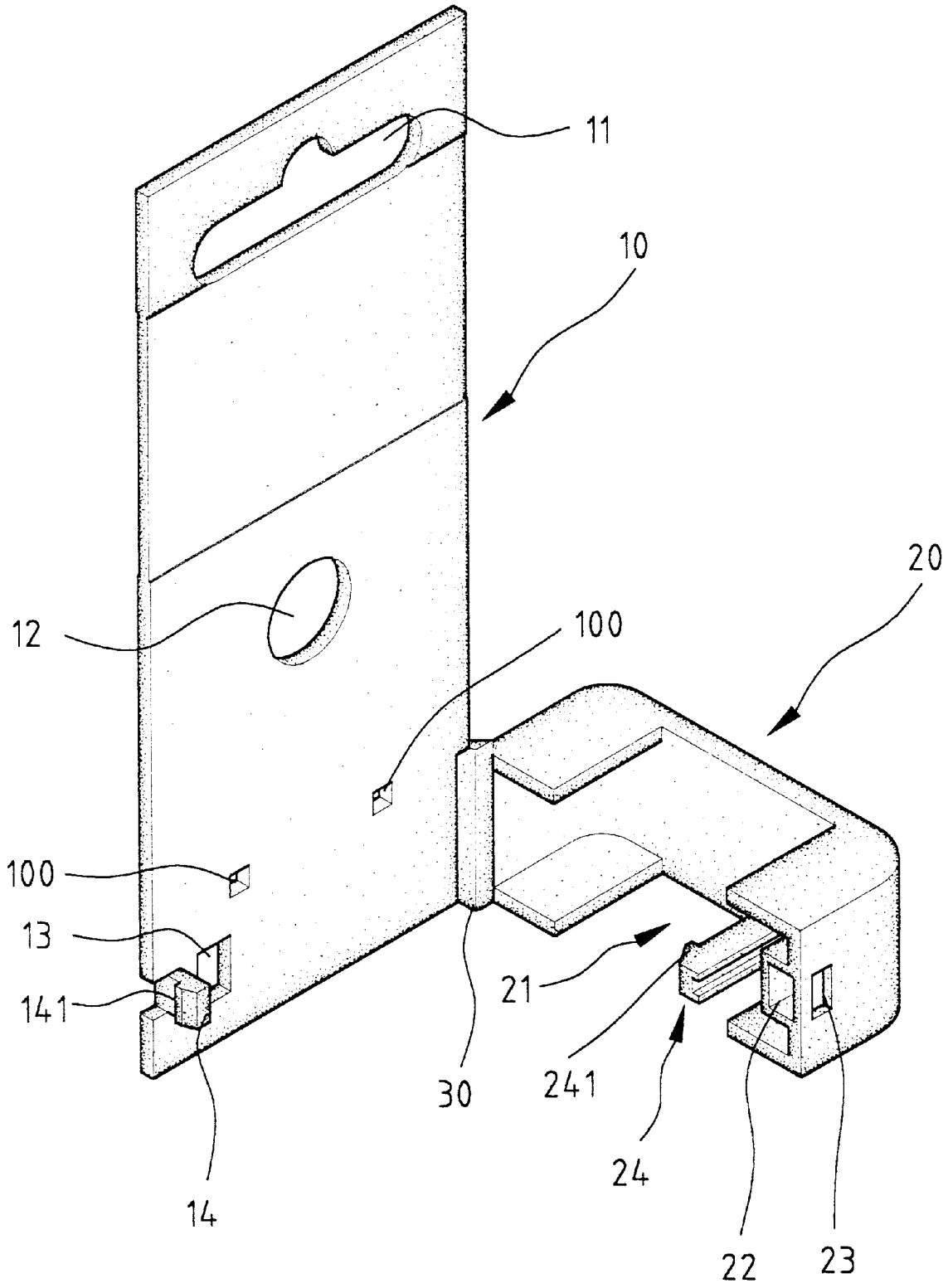
FIG. 1 is a perspective view of the tool display rack in accordance with the present invention, wherein the limiting member is in the opened position.
Figure 2:
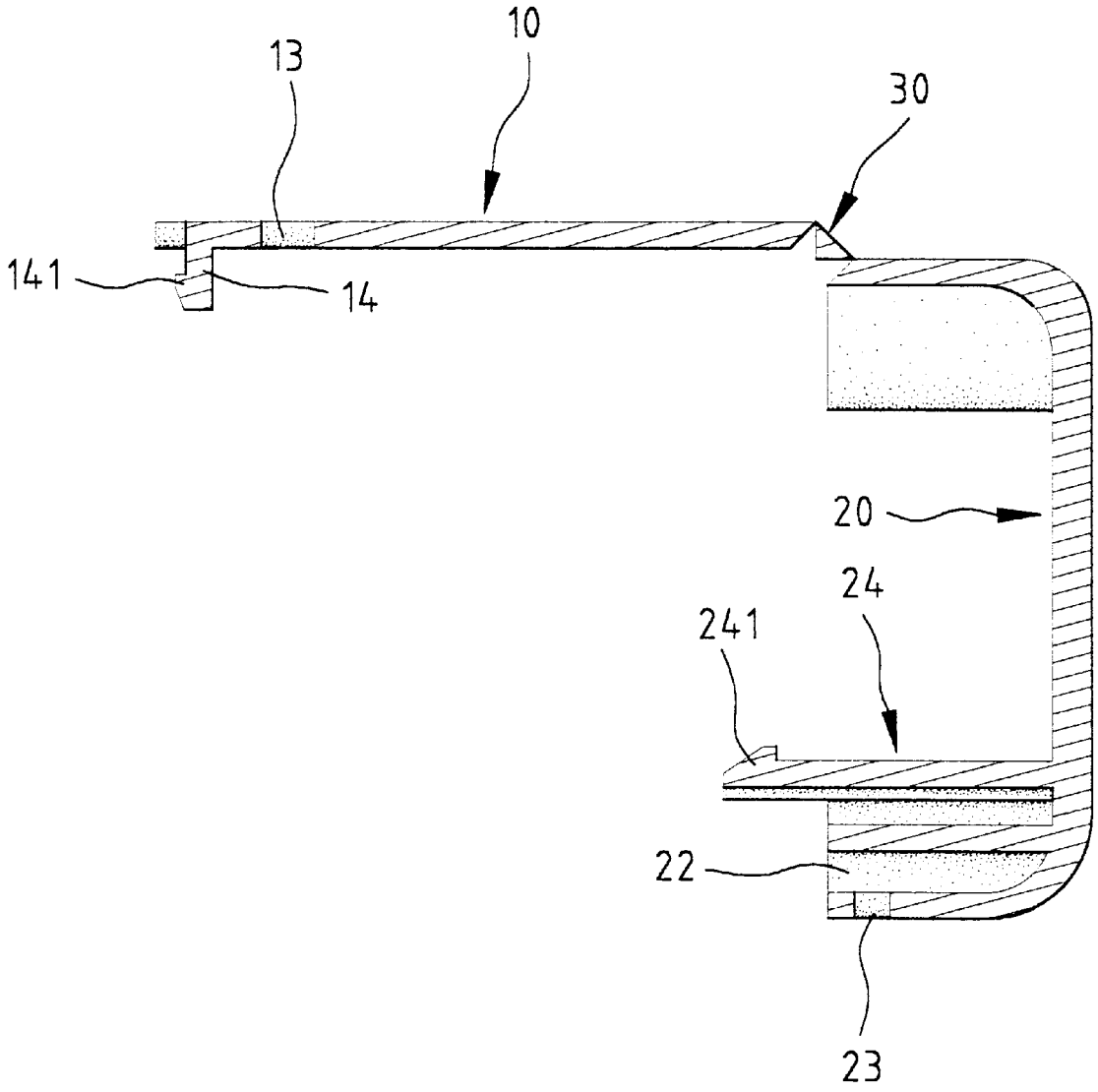
FIG. 2 is a top elevational view, partly in section, of the tool display rack as shown in FIG. 1.

Referring to FIGS. 1 and 2, the tool display rack in accordance with the present invention comprises a body 10 having a first aperture 13 defined in the first end thereof and located near the first side of the body 10, a first engaging member 14 extending from the body 10 and located near the first side of the body 10. The first engaging member 14 has a hook-shaped head 141. A slot 11 is defined in the second end of the body 10 and a hole 12 is defined through the body 10 and located between the slot 11 and the first aperture 13.

Figure 3:
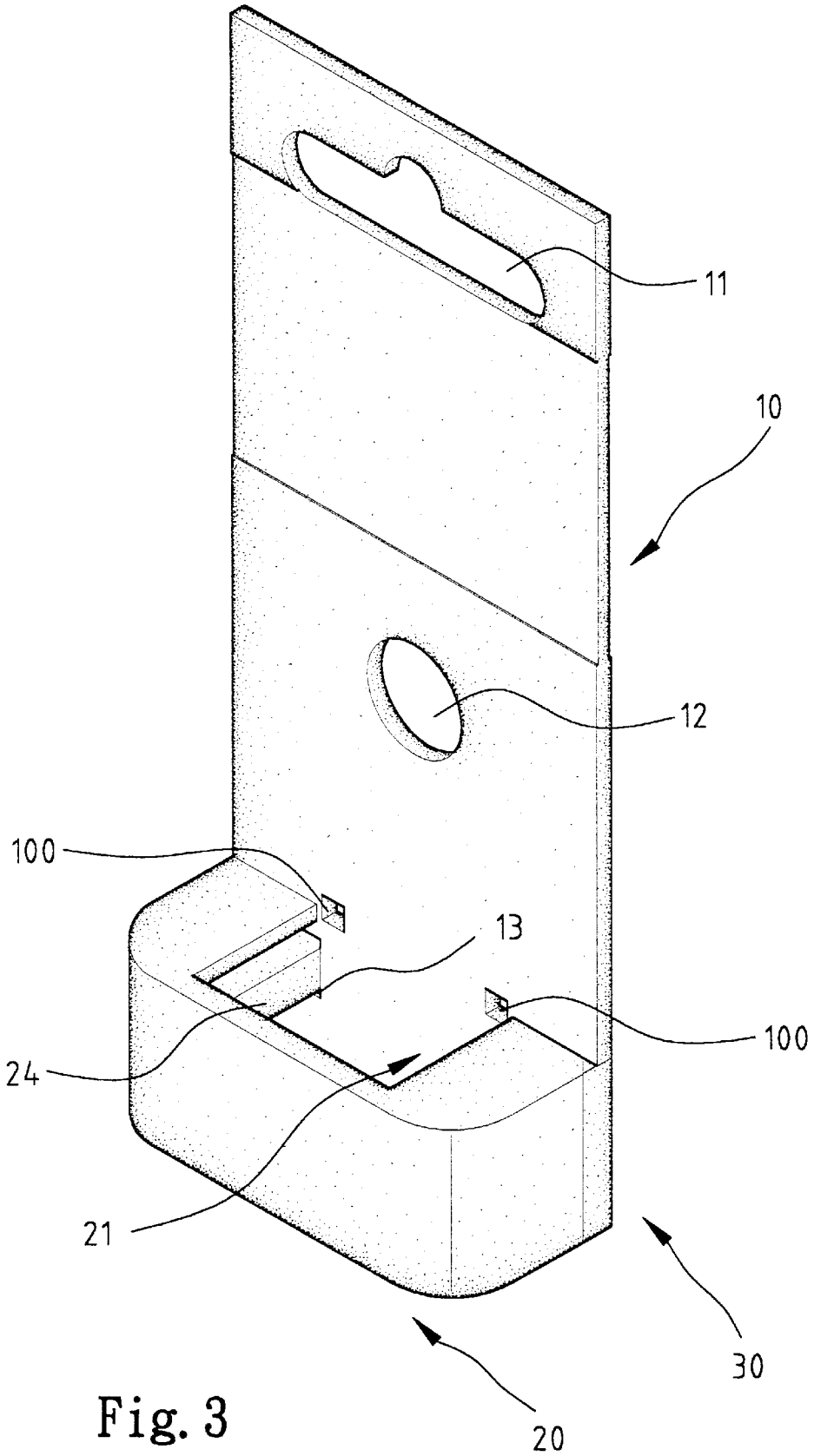
FIG. 3 is a perspective view to show the tool display rack wherein the limiting member is in the closed position.
Figure 4:
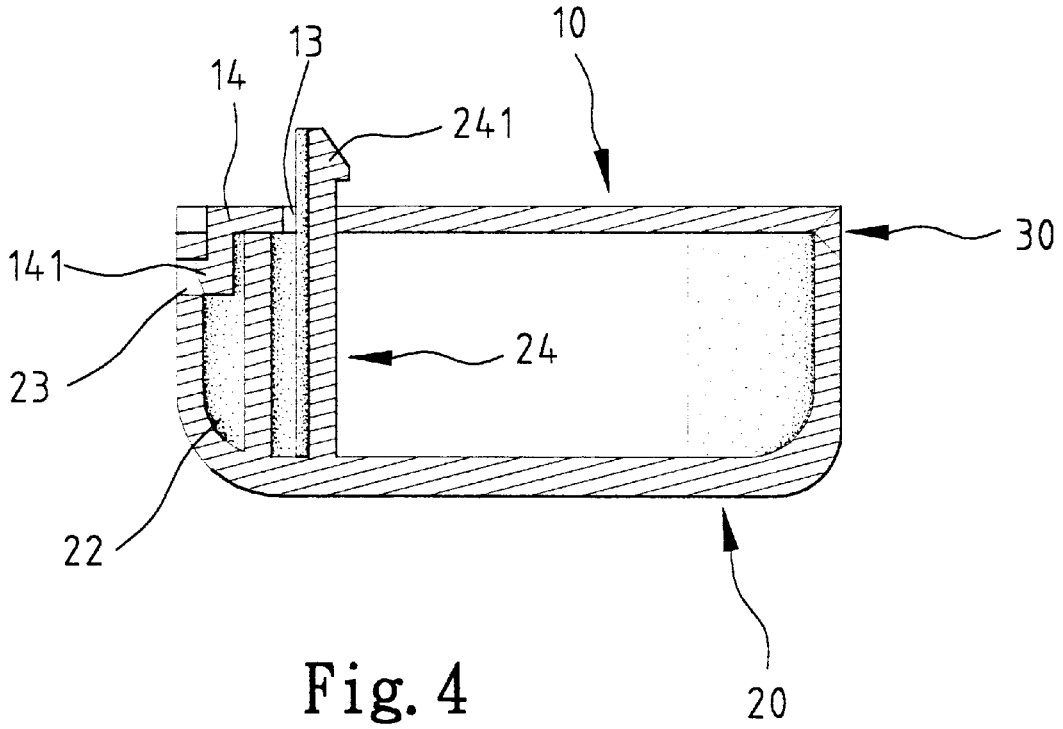
FIG. 4 is a top elevational view, partly in section, of the tool display rack as shown in FIG. 3.
Figure 5:
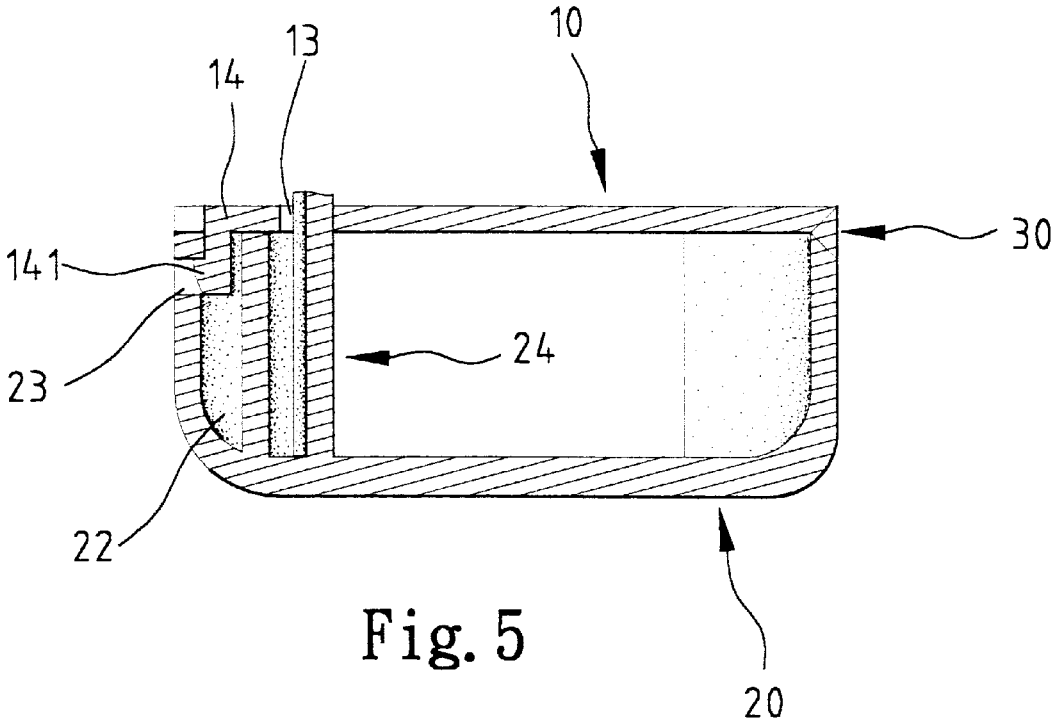
FIG. 5 is a top elevational view, partly in section, showing the second engaging member extending through the body is cut.

A connecting plate 30 extends from the second side of the body 10 and is connected to the first end of a limiting member 20 which has a recess 21 defined therein. Referring to FIGS. 3 and 4, a second aperture 22 is defined in the second end of the limiting member 20 so as to receive the first engaging member 14 of the body 10, and a second engaging member 24 extends from the second end of the limiting member 20 so as to engage with the first aperture 13 in the body 10. The second engaging member 24 has a hook-shaped head 241 extending through the body 10 via the first aperture 13 so that when the limiting member 20 is pivoted about the connecting member 30 from the opened position to the closed position, the first engaging member 14 is engaged with the second aperture 22 and the second engaging member 24 is engaged with the first aperture 13. It is to be noted that a side opening 23 is defined laterally in the second end of the limiting member 20 and communicates with the second aperture 22 so that the hook-shaped head 141 of the first engaging member 14 is engaged with the side opening 23. Once the limiting member 20 is in the closed position, it cannot be opened again except cutting the hook-shaped head 241 of the second engaging member 24 as shown in FIG. 5. Such the structure performs an antitheft function.

Figure 6:
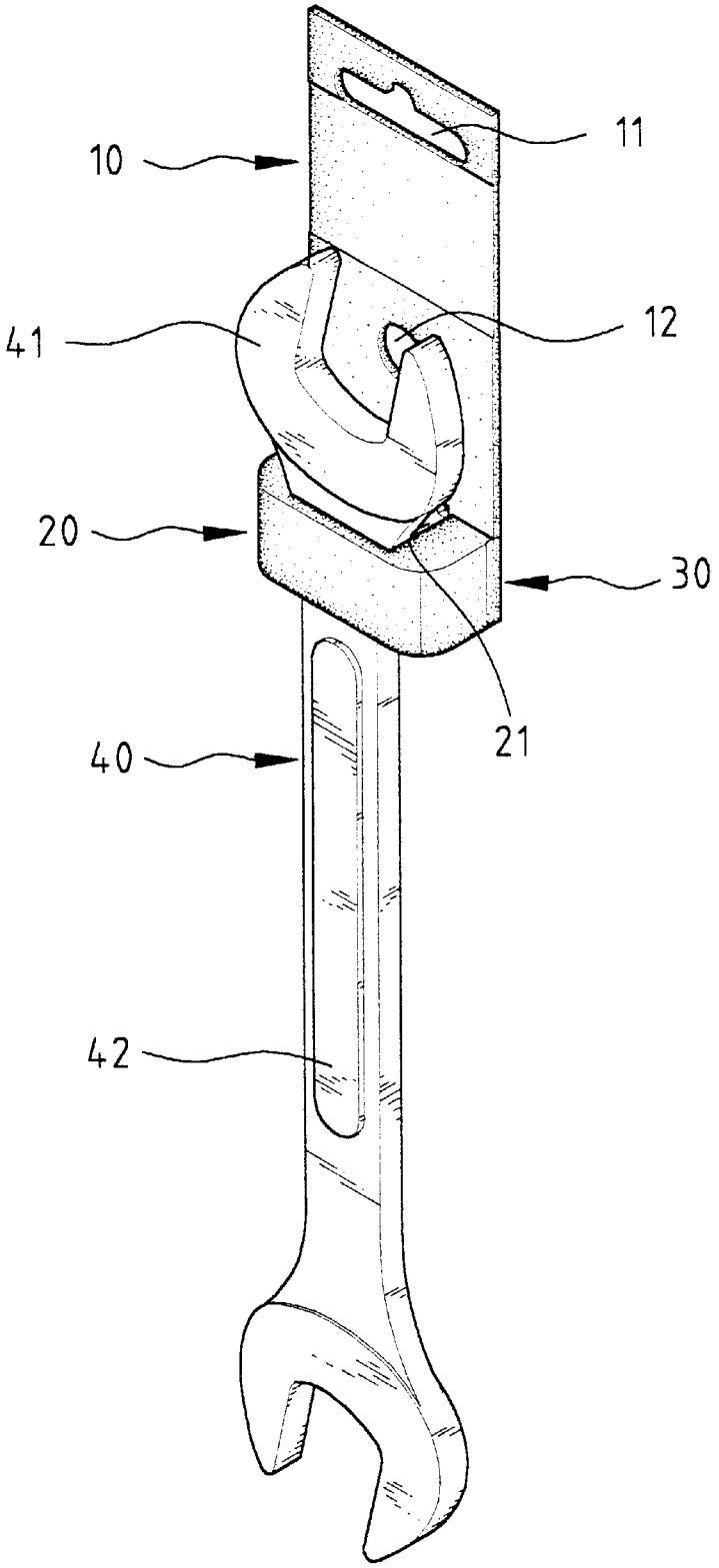
FIG. 6 is a perspective view to show a spanner is connected to the body and limited by the limiting member.
Figure 7:
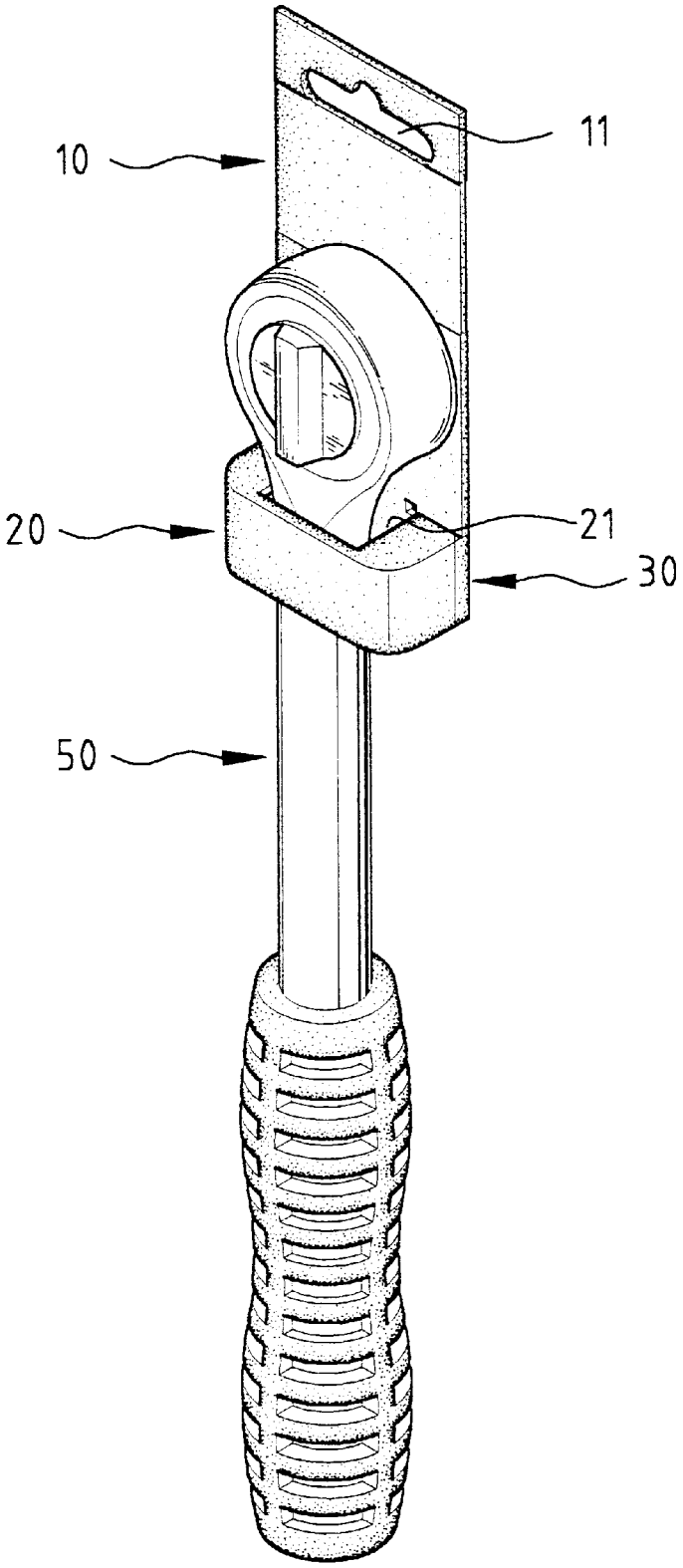
FIG. 7 is a perspective view to show a wrench is connected to the body and limited by the limiting member.
Figure 8:
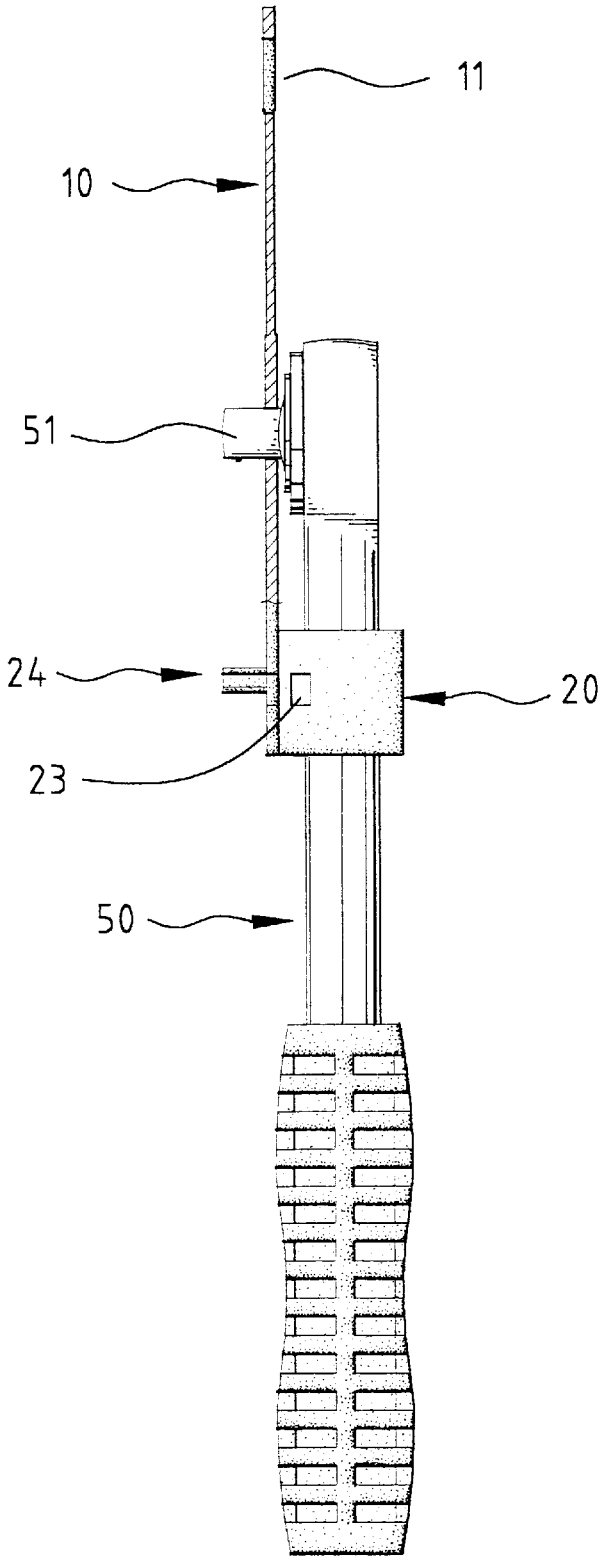
FIG. 8 is a side elevational view to show the driving shaft of the wrench extending through the hole of the body.

Referring to FIGS. 6 through 8, a spanner 40 is attached to the display rack by extending the shank 42 thereof through the recess 21 defined between the body 10 and the limiting member 20, wherein the two function ends 41 of the spanner 40 are limited by the limiting member 20. A wrench tool is also able to be attached to the display rack wherein the shank 50 extends through the recess 21 and the driving shaft 51 of the wrench tool extends through the hole 12.

For a safety sake, two holes 100 are defined through the body 10 and respectively located to the first side and the second side of the body 10, so that a wire (not shown) may extend through the two holes 100 and wraps around to the tool extending through the recess 21, so that the tool will not drop when cutting the hook-shaped head 241 of the second engaging member 24.

While we have shown and described various embodiments in accordance with the present invention, it should be clear to those skilled in the art that further embodiments may be made without departing from the scope and spirit of the present invention.

What is claimed is:

1. A tool display rack comprising:

a body having a first aperture defined in a first end thereof and located adjacent to a first side of said body, a first engaging member extending from said body and located adjacent to said first side of said body, and a connecting plate extending from a second side of said body, a limiting member having a first end thereof connected to said connecting plate and having a recess defined therein, a second aperture defined in a second end of said limiting member so as to receive said first engaging member of said body, a second engaging member extending from the second end of said limiting member so as to engage with said first aperture in said body, further comprising a side opening defined laterally in said second end of said limiting member and communicating with said second aperture, said first engaging member having a hook-shaped head which is engaged with said side opening.

* * * * *